United States Patent [19]

Van Patten

[11] Patent Number: 4,612,908

[45] Date of Patent: Sep. 23, 1986

[54] VIEWING INSTRUMENT FOR CHIMNEY

[76] Inventor: Frederic D. Van Patten, R.D. 1, Stock Rd., Hannibal, N.Y. 13074

[21] Appl. No.: 747,870

[22] Filed: Jun. 24, 1985

[51] Int. Cl.[4] ..... F24D 15/04

[52] U.S. Cl. ..... 126/200; 126/120; 431/13

[58] Field of Search ..... 126/120, 200, 307 R, 126/312; 165/DIG. 2, 11 R; 110/184, 193; 431/13; 98/45, 46; 350/631; 356/445

[56] References Cited

U.S. PATENT DOCUMENTS 1,614,466 1/1927 Gearon ..... 126/200

3,151,612 10/1964 Keeling, Sr. et al. ..... 126/200

*Primary Examiner*—Randall L. Green

*Attorney, Agent, or Firm*—Bruns and Wall

[57] ABSTRACT

An instrument for viewing the vent of a chimney while the chimney is working that includes a quartz rod that is mounted in the chimney above the flue entrance thereto. The rod is adapted to transmit light travelling down the chimney to a viewing station outside the chimney wall to provide valuable visual information concerning the condition of the chimney and the burning efficiency of the fire.

4 Claims, 6 Drawing Figures

FIG. 3
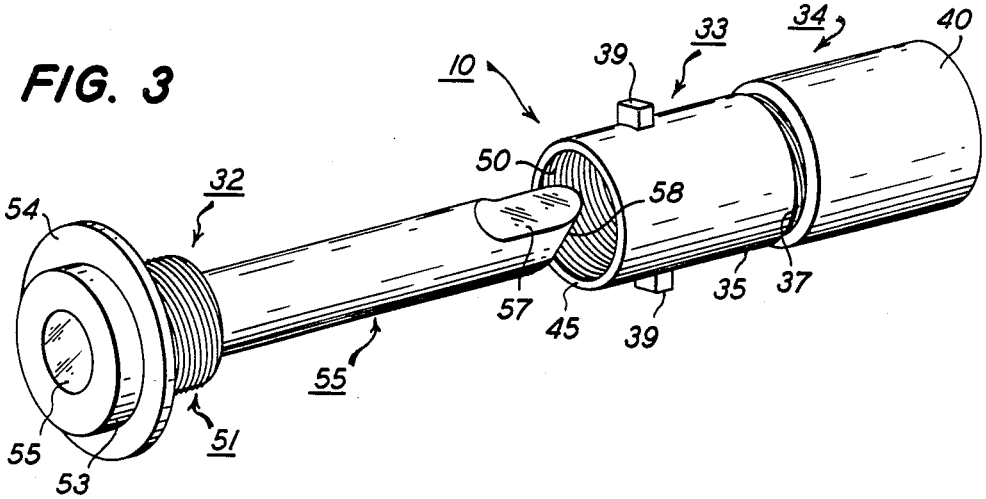
FIG. 6
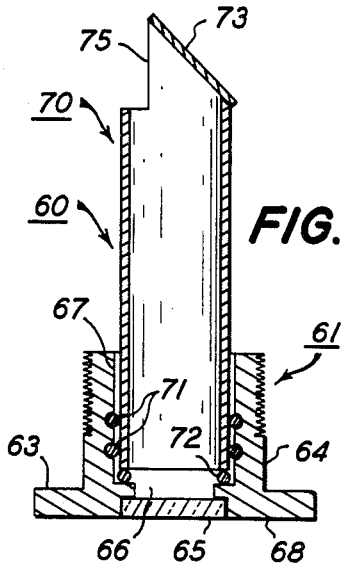
FIG. 4
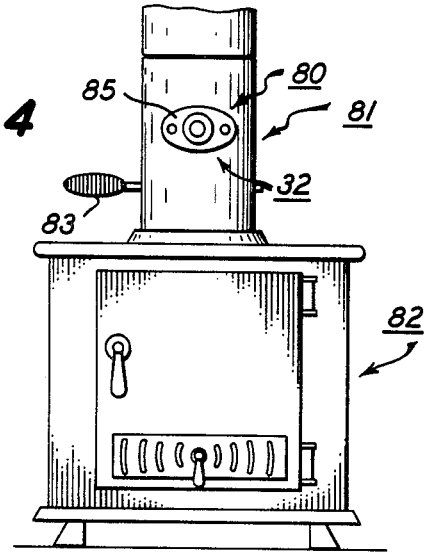
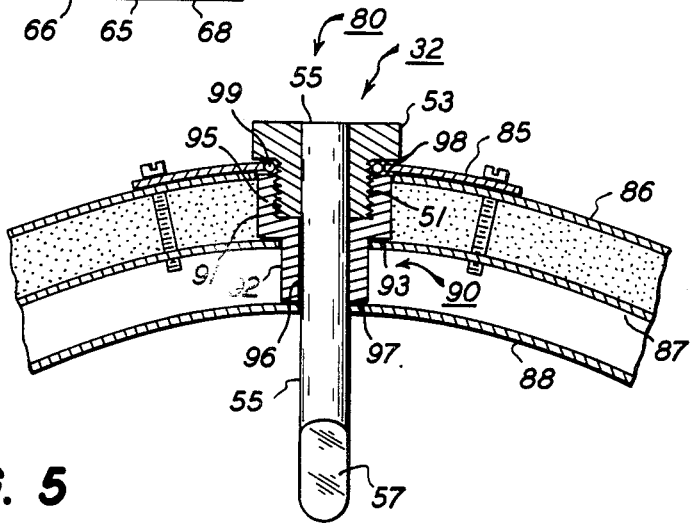
FIG. 5

VIEWING INSTRUMENT FOR CHIMNEY

BACKGROUND OF THE INVENTION

This invention relates to apparatus for observing the interior of a chimney during periods when the chimney is working to determine the burning operation of a stove being serviced by the chimney and for the condition of the chimney.

In U.S. Pat. No. 4,434,784 which issued to Van Patten on Mar. 6, 1984, there is disclosed a chimney viewing system that is intended to be installed below a flue pipe leading into the chimney. The device consists of an airtight viewing window that is mounted in the chimney immediately below the flue entrance and a bracket mounted mirror positioned inside the chimney adjacent the window. A person outside the chimney looking through the window was thus provided an unimpeded view up the chimney whereby both the smoke column and the physical condition of the interior chimney surfaces can be observed while an associated stove or the like is working. As noted in this patent, smoke pattern can be used to adjust the stove to provide for optimum burning conditions and any defects in the chimney structure can be readily detected. This device has proven to be quite effective in practice and leads to a decrease in creosote buildup on the chimney and greater safety where the stove is used to burn wood.

Although the prior Van Patten device has proved to work quite well in practice it can only be installed where the chimney extends below the flue entrance. In many applications such as existing fireplaces, fireplaces equipped with stove inserts or free standing stoves using multiwall metal pipe chimneys, the underflue device can not be effectively utilized. Placing the mirror and mirror bracket in the flue chamber disturbs the drawing characteristics of the chimney. Furthermore, the mirror tends to become degraded by heat and quickly looses its reflecting capabilities. Lastly, a large access hole must be cut into the chimney which particularly in the case of a fireplace can be objectionable from an aesthetic stand point and might cause severe structural damage to the chimney.

SUMMARY OF THE INVENTION

It is therefore an object of the present invention to improve wood burning stoves and fireplaces and particularly the safety of these devices.

It is another object of the present invention to provide viewing apparatus that can be inserted directly into the smoke pattern of a working chimney.

Yet another object of the present invention is to provide a heat insensitive viewing system for inspecting the inside of a chimney while the chimney is working.

A still further object of the present invention is to provide an optical system for viewing the inside of a chimney that can be safely installed within an existing fireplace.

Another object of the present invention is to provide an optical viewing system that can be quickly and easily installed within a multiwall metal chimney without compromising the operation of the chimney.

These an other objects of the present invention are attained by means of an optical inspection device that includes a hollow barrel arranged to pass through the chimney, an eyepiece having a window which is threadably received into the barrel, a light transmitting rod axially aligned with the eyepiece and contained therein that extends into the chimney, a reflecting surface positioned at the terminal end of the rod for directing light along the axis of the rod whereby a person looking in the window is able to look up the chimney to inspect either smoke patterns in the chimney or the internal condition of the chimney structure.

BRIEF DESCRIPTION OF THE DRAWINGS

For a better understanding of these and other objects of the present invention reference is had to the detailed description of the invention which is to be read in conjunction with the accompanying drawings, wherein:

FIG. 3 is an exploded view in perspective showing the viewing device of FIG. 1;

FIG. 4 is a front elevation showing a wood burning stove having a metal chimney embodying a viewing device encompassing the present invention;

FIG. 5 is a partial top view in section of the metal stove chimney illustrated in FIG. 4 further showing the instant viewing device; and FIG. 6 is a partial side view of a lens assembly used in the practice of the present invention.

DESCRIPTION OF THE INVENTION

Figure 1:
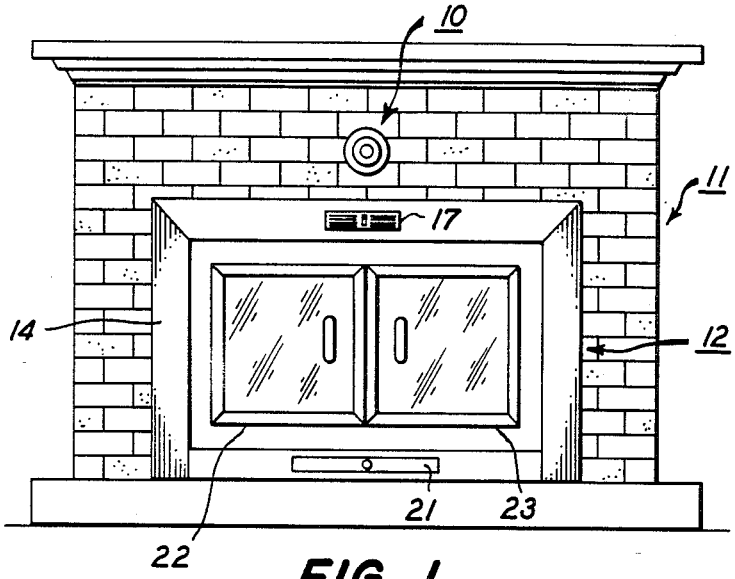
FIG. 1 is a front elevation showing a fireplace that contains a viewing device embodying the present invention.
Figure 2:
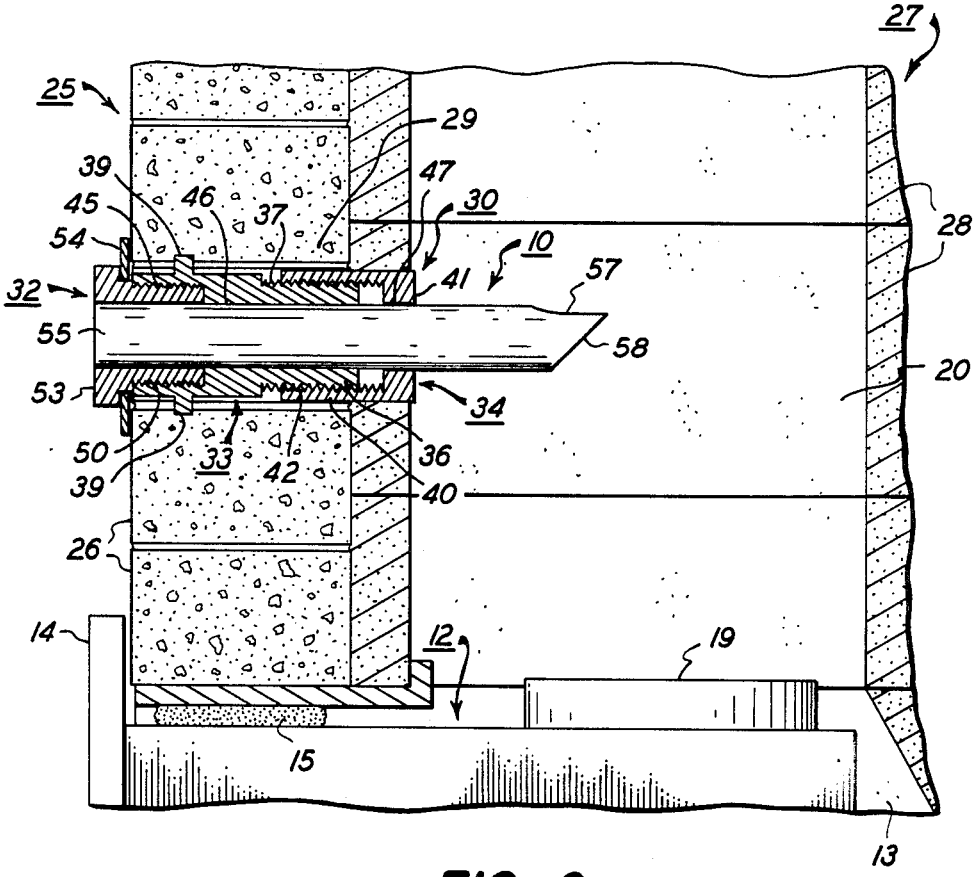
FIG. 2 is an enlarged end view in section showing the viewing device illustrated in FIG. 1 mounted inside a chimney.

Turning initially to FIGS. 1–3, there is shown a viewing instrument, generally designated 10, that embodies the teaching of the present invention that is suitable for use in association with a conventional brick fireplace 11. As is now common practice an airtight stove 12 has been fitted into the firebox 13 of the fireplace through the front entrance thereto and the entrance sealed by means of a frame 14. A fireproof packing material 15 (FIG. 2) is used to seal any air spaces between the stove and fireplace entrance to render the firebox region airtight. The stove contains a damper control handle 17 that is used to open and/or close a slide plate damper located within the flue opening 19 which regulates the amount of gas (smoke) emitted into the chimney vent chamber 20. An adjustable air inlet 21 is also located at the front of the stove which can be regulated to control the amount of combustion air admitted into the stove burning chamber. A pair of doors 22 and 23 are used to charge wood into the burning chamber.

As best illustrated in FIG. 2, the fireplace contains a brick facade 25 made up of individual bricks 26-26 mortared at the joints and rearwardly situated chimney 27 made up of stacked refractory tiles 28-28. A hole 29 is cored through the brick and refractory tile using any type of suitable tool. Preferably, the hole is horizontally aligned so that it is perpendicular with the front face of the brick facade. The viewing instrument 10 is slidably received with the cored hole.

The viewing instrument includes an optical barrel assembly 30 into which is threaded what herein will be refered to as a light transmitting unit 32. As shown in FIGS. 2 and 3, the barrel assembly includes an outside housing 33 and an inside housing 34 that are threaded together so that the axial length of the assembly can be adjusted to accommodate various width fireplace wall structures. The outer housing has a tubular body 35 from which is projected a smaller diameter elongated shank 36 containing external threads 37. The inside housing further contains a pair of radially extended lugs 39-39 that are slidably received in retaining grooves cut into the fireplace for holding the barrel assembly in the cored hole. In assembly, the retaining grooves are mortared closed to keep the assembly in place.

The inside housing 34 includes a tubular body 40 that is closed at one end by an integral end cap 41. The body contains internal threads 42 which are adapted to mate with the threads on the shank of the outside housing whereby the outside housing can be operatively joined to the inside housing as shown in FIG. 2. By use of this threaded connection, the overall axial length of the optical barrel can be adjusted so that the end face of the outside housing will be flush with the inside surface of the chimney. Accordingly, any disturbance of the flow patterns inside the chimney are minimized. In assembly, the barrel is sealed in the opening by means of a refractory cement.

The outside housing also contains an expanded opening 45 at the outer end opposite the elongated shank which communicates with a smaller diameter opening 46 that passes through the entire length of the housing. The smaller diameter opening is coaxially aligned with an opening 47 formed in the end wall of the inside housing. Both openings 46 and 47 are of the same diameter. The internal surface of the expanded opening contains threads 50 that are arranged to mate with a threaded hub 51 contained on the light transmitting unit 32.

The light transmitting unit 32 includes a quartz rod 55 that is supported at its proximal end within the hub 51. In assembly, the hub, as noted, is threaded into the optical barrel and the rod is passed through the openings 46 and 47 so that it projects into the chimney vent well away from the interior wall thereof. A close sliding fit is provided between the rod and the two openings so that the rod is well supported in assembly. The hub 51 contains a radially expanded outer flange 53 that coacts with an annular washer 54 to lock the unit against the front face of the fireplace. The light exit face 55 of the rod is flush-mounted with the outer surface of the hub and provides a viewing window. In assembly, the rod is secured in the hub using epoxy cement or the like to position the distal or free end of the rod as shown in FIG. 2.

The distal end of the rod is provided with a flat light entrance face 57 that is horizontally disposed in assembly so that it faces the top chimney opening. The end of the rod also contains a ground or polished light reflecting surface 58 that is immediately below the light entrance face. The reflecting surface, in assembly, is placed at a 45° angle with the light entrance so that entering light is directed along the tube and passes out the exit face to furnish a view of the interior of the chimney.

As can be seen, the quartz rod is insensitive to the relatively high temperature that it is exposed to in this region of the chimney. Also because of its size and shape, the rod will not disturb the operation of the chimney. Tests have been conducted which show that a $\frac{5}{8}$ to $\frac{3}{4}$ inch diameter rod works quite well in practice while at the same time furnishing an excellent view up the chimney. As described in the previously noted Van Patten patent, the viewing instrument can be used while the stove is working to provide valuable information concerning the condition of the chimney and the operation of the stove. Through this visual inspection, the stove owner can quickly tell when the chimney becomes dangerously coated with creosote and thus prevent chimney fires. The rod as herein described can remain in the chimney for long periods of time without adversely effecting its ability to transmit an image.

Turning now to FIG. 6, there is shown another embodiment of a light transfer unit suitable for use in the viewing instrument shown in FIGS. 1-3. This unit is generally referenced 60 and includes a threaded hub 61 that can be screwed into the optical barrel assembly 30 described above. The hub contains an expanded flange 63 and a threaded body 64. A clear glass window 65 is cemented into the front face of the hub which opens into an axially aligned opening 66 formed in the hub. The opening contains an enlarged chamber 67 that terminates at a vertical wall 68. The chamber is arranged to slidably receive a hollow quartz tube 70 therein.

The tube is held in the hub by means of a pair of O-rings 71-71 contained in parallel grooves formed in the chamber sidewall. The O-rings, in assembly, apply a biasing holding force against the outside surface of the tube to securely hold the tube within the hub. A third 0-ring 72 is placed between the end face of the tube and the back wall of the chamber which prevents the tube from being damaged during insertion.

The free end of the quartz tube extends into the chimney vent in assembly. This end of the tube is provided with a 45° surface over which is fused a circular reflecting disc 73. A clear opening 75 is cut in the wall of the tube immediately over the disc. The interior plane of the reflecting disc has a mirrored surface that looks out through the clear opening to view the chimney. The mirror surface is thus housed inside the tube and shielded, to a large extent, from the smoke and other gases travelling up the chimney and as in the case of the solid rod will not be contaminated by dirty vent gases.

With further reference to FIGS. 4 and 5, there is shown a viewing instrument 80 being used in a triple walled metal chimney 81 used in association with a free standing wood burning stove 82. The instrument is situated upstream from the flue damper 83 where it is capable of viewing a straight run of pipe leading to the chimney exits. The instrument operates in the same manner as described above to bring reflected light images to a viewer standing near the stove.

As seen in FIG. 5, the instrument includes a light transmitting unit 32 as described above containing a circular quartz rod 55 that is cemented into a threaded hub 51. The end of the rod is provided with a flat light entrance face 57 that acts in conjunction with a reflecting surface to direct light towards the light exit face 55. In this embodiment of the invention, the flanged end 53 of the hub acts against a mounting plate 85 that is secured to the outside of the chimney by means of metal screws threaded into the outer wall 86 and intermediate wall 87 making up the three wall chimney. As is common in the art, the space between the walls 86 and 87 is packed with insulation to prevent unwanted heat loss in this region. The region between the intermediate wall 87 and the inner wall 88 of the chimney contains free air which also serves as an insulation.

The optical barrel 90 used to connect the light transmitting unit to the chimney in this case involves a one piece element that is specially fabricated to accommodate the three wall metal pipe chimney construction. The barrel is a cylindrical member having a first large diameter body section 91 and a smaller diameter spacer section 92. A radially disposed locating wall 93 separates the two sections. A large hole is initially formed in the outer wall 86 of the chimney to receive the body of the barrel therein. A coaxially aligned second smaller diameter hole is then formed in the intermediate walls 87 of the chimney and a third smaller hole similarly formed in the inner wall. The second hole in the wall 87 is adapted to receive the spacer section 92 therein while the third hole is adapted to receive the quartz rod therein.

The main body of the barrel has an internally threaded opening 95 that leads into a circular channel 96 through which the quartz rod is inserted into the chimney. In assembly, the cover plate is removed and the barrel inserted into the three wall chimney through the holes provided. The end face 97 of the barrel abuts the inside of wall 88 while the locating wall 93 abuts wall 87 as shown in FIG. 5. This, in turn, places the outer end face 98 flush with the outer wall 86. With the barrel thus positioned, the cover plate is screwed in place to secure the barrel in the chimney. Next the light transmitting unit is threaded into the barrel to place the light entrance face of the rod so that it looks up the chimney. An O-ring 99 is positioned between the hub 51 and the barrel to render the instrument airtight. The threaded parts can be cemented in assembly to prevent them from moving out of position after assembly.

While this invention has been described with specific reference to the structure disclosed herein, it is not necessarily confined to the details as set forth and this application is intended to cover all modifications and changes that may come within the scope of the following claims.

I claim:

1. Apparatus for visually monitoring the vent of a chimney while the chimney is drawing exhaust gases from a fire through a flue opening that includes a hollow barrel positioned within a horizontal receiving opening that passes from outside the chimney into the chimney vent above the flue entrance, mounting means joined to the outer end of the barrel for providing an airtight seal with said chimney and having a transparent window for viewing the inside of said chimeny, an elongated, heat resistant tube contained within the mounting means that passes through the barrel into the chimney vent, said tube having one end positioned adjacent said window and the opposite end positioned in the chimney vent, said tube further including an opening in the sidewall thereof that faces the top of the chimney, and a mirror means positioned beneath the opening for directing light entering the top of the chimney through said tube toward the window whereby the chimney vent can be viewed through the window.

2. The apparatus of claim 1 that further includes a plurality of resilent O-rings positioned inside the mounting means for receiving the tube therein with a friction fit to hold the tube inside the mounting means.

3. The apparatus of claim 1 wherein the mirror means is a reflecting disc fused to the free end of the tube at an angle of about 45 degrees with the axis of said tube.

4. The apparatus of claim 1 wherein said barrel unit further includes an adjusting means for setting the barrel length within the chimney opening.

* * * * *